US005605354A

United States Patent [19]

Kwon

[11] Patent Number: 5,605,354

[45] Date of Patent: Feb. 25, 1997

[54] ALBUM

[76] Inventor: Hyung-Seok Kwon, 790-37, Sihung 4-Dong, Kulo-Gu, Seoul 152-034, Rep. of Korea

[21] Appl. No.: 502,325

[22] Filed: Jul. 13, 1995

[30] Foreign Application Priority Data

May 27, 1995 [KR] Rep. of Korea ..... 95-11647

[51] Int. Cl.[6] ..... B42D 1/08; B42F 5/00; G09F 9/00

[52] U.S. Cl. ..... 281/22; 40/721; 40/734; D19/26

[58] Field of Search ..... 281/21.1, 22, 29, 281/33; 40/721, 734; D19/26, 27

[56] References Cited

U.S. PATENT DOCUMENTS

| | | | |
|---|---|---|---|
| D. 19,487 | 12/1889 | Hafely | 281/22 X |
| D. 19,527 | 12/1889 | Petri | 281/22 X |
| D. 248,964 | 8/1978 | Kizlauskas | D19/26 X |
| 260,535 | 7/1882 | Caterson | 40/775 X |
| 432,410 | 7/1890 | Jaeger | 281/22 X |
| 1,264,938 | 5/1918 | Jameson | 40/721 X |
| 1,415,429 | 5/1922 | Cueny | 281/22 |
| 2,329,007 | 9/1943 | Simon et al. | 40/734 X |
| 2,649,799 | 8/1953 | Spertus | 40/721 |
| 4,332,095 | 6/1982 | Tanney | 40/771 |
| 4,637,631 | 1/1987 | Baer | D19/26 X |
| 4,830,404 | 5/1989 | Lu | 40/775 X |
| 5,400,532 | 3/1995 | Grove | 40/721 |

*Primary Examiner*—Frances Han
*Attorney, Agent, or Firm*—Jerry Cohen

[57] ABSTRACT

An album used as a picture frame and a mirror is disclosed. The album has top and bottom frames pivoted to each other and a front cover pivoted to the top side of the bottom frame. The cover is provided with a mirror on its inside surface. A binder's board sheet is pivoted to the right side of the bottom frame such that the board sheet is positioned between the top and bottom frame. The top portion of the board sheet is provided with a pair of binder rings. A plurality of picture mount sheets are bound on the binder's board sheet by the binder ring. The binder's board sheet has a holding groove formed about the hinge pivoting the board sheet to the right side of the bottom frame.

2 Claims, 5 Drawing Sheets

ALBUM

BACKGROUND OF THE INVENTION

1. Field of the Invention

The present invention relates in general to albums and, more particularly, to an album having a synthetic resin front cover with a mirror on the inside surface, top and bottom frames hinged to each other, a cover hinged to the top frame, a binder's board sheet having a plurality of picture mount sheets and hinged to the right side of the bottom frame, thereby preferably used as a portable album keeping the pictures in the picture mount sheets and also used as a picture frame and a portable mirror.

2. Description of the Prior art

Several types of albums used for other purposes, such as picture frames, have been proposed. However, each of the typical albums used as picture frames comprises a typical picture frame simply combined with a plurality of picture mount sheets on its rear side. However, as the above albums used as picture frames are nothing but typical picture frames merely provided with spare pictures on their rear sides so that they have been scarcely used.

SUMMARY OF THE INVENTION

It is, therefore, an object of the present invention to provide an album in which the above problem caused by the typical album used as a picture frame can be overcome and which is used as a portable album keeping the pictures in the picture mount sheets and also used as a picture frame and a portable mirror.

In order to accomplish the above object, an album in accordance with a preferred embodiment of the present invention comprises top and bottom frames having their openings, the top frame being pivoted to the top side of the bottom frame by means of a first hinge; a front cover pivoted to the top side of the bottom frame by means of a second hinge such that the top frame is positioned between the front cover and the bottom frame, the cover being provided with a mirror on its inside surface and the second hinge having a protrusion and a protrusion receiving hole; a binder's board sheet pivoted to the right side of the bottom frame by means of a third hinge such that the board sheet is positioned between the top and bottom frame, the top portion of the binder's board sheet being provided with at least one binder ring; and a plurality of picture mount sheets for keeping pictures therein, the picture mount sheets being bound on the binder's board sheet by the binder ring.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
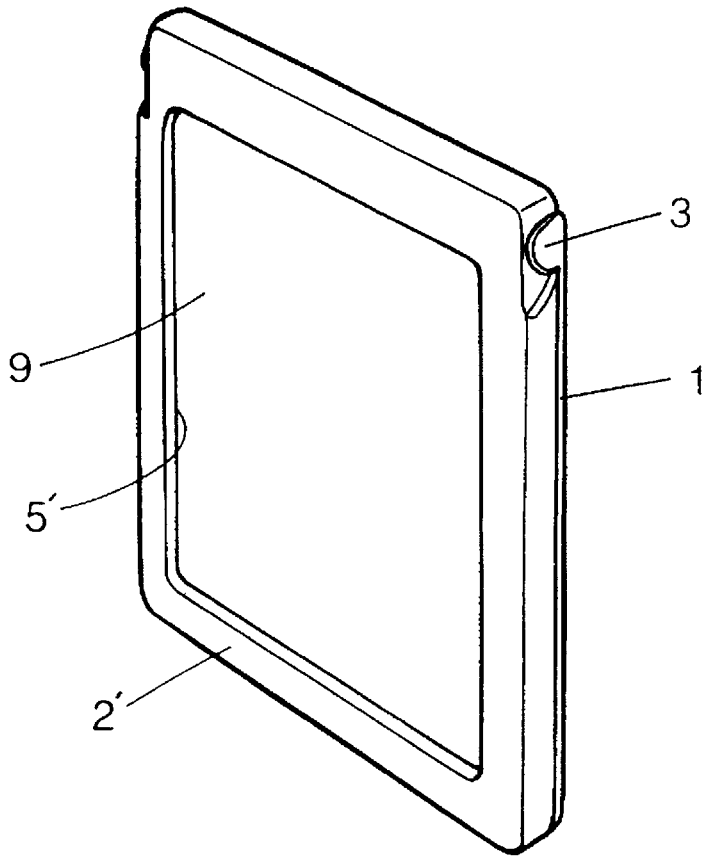
FIG. 1 is a perspective view of an album in accordance with a primary embodiment of the present invention, showing the outer appearance of the album.
Figure 2:
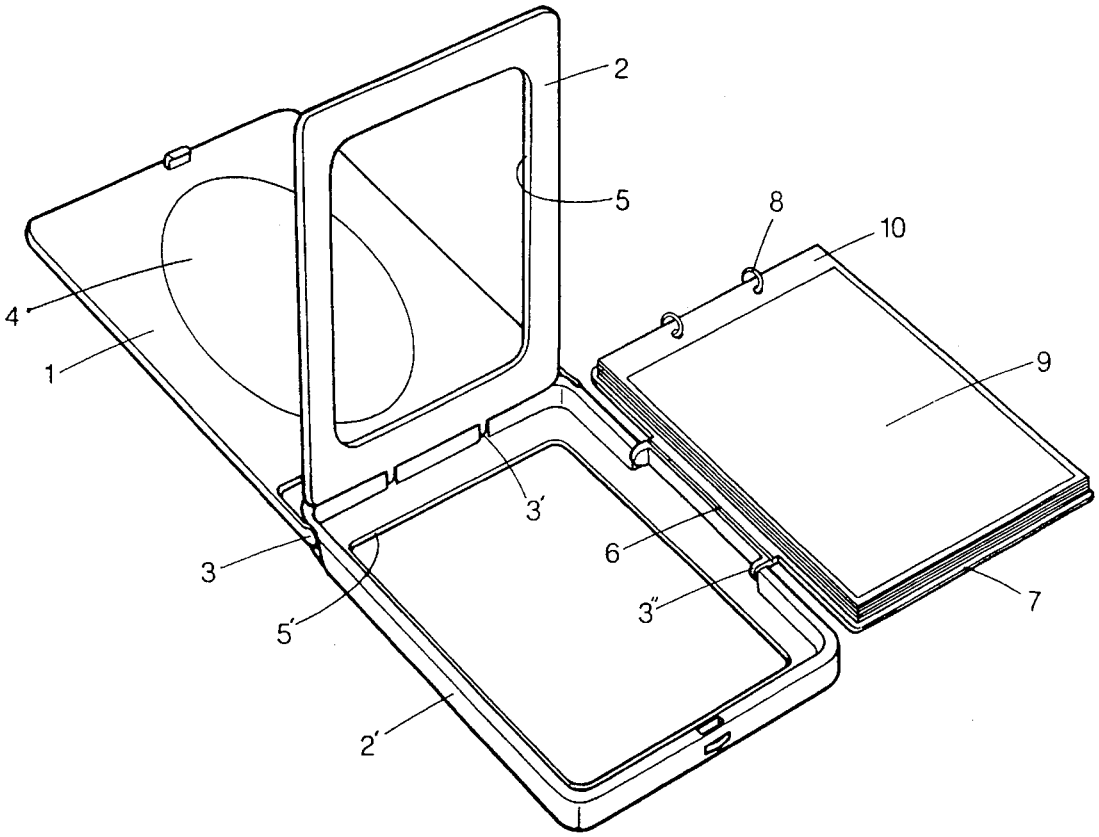
FIG. 2 is a perspective view of the album of FIG. 1, showing the album fully opened.

FIG. 1 is a perspective view showing the outer appearance of an album in accordance with a primary embodiment of the invention and FIG. 2 is a perspective view showing the album in the fully opened state. As shown in the drawings, the album of this invention, made of synthetic resin to be easy to carry and use, includes a front cover 1 and top and bottom frames 2 and 2'. The cover 1 and the top frame 2 are pivoted to the top side of the bottom frame 2' using hinges 3 and 3' respectively. A mirror 4 is mounted to the inside surface of the cover 1. The top and bottom frames 2 and 2' have their openings 5 and 5'. Pivoted to the right side of the bottom frame 2' using a hinge 3" is a sheet 7 of heavy binder's board. The binder's board sheet 7, which has a folding groove 6 on its inside end, is provided with a pair of binder rings 8 on its top portion. A plurality of picture mount sheets 10 for keeping pictures 9 are bound on the sheet 7 by the rings 8 in order.

Figure 3:
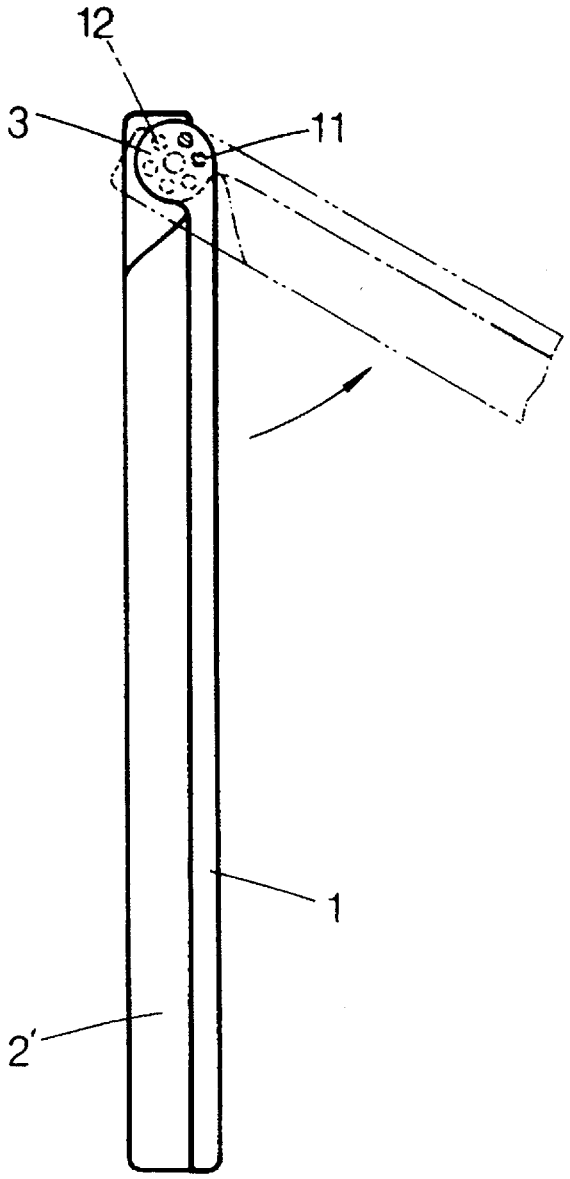
FIG. 3 is a side view of the album of FIG. 1, showing the hinged coupling structure between the bottom frame and the front cover of the album.

FIG. 3 is a side view of the album of FIG. 1, showing the hinged coupling structure between the bottom frame 2' and the front cover 1. As shown in this drawing, a plurality of protrusions 11 and their corresponding receiving holes 12 are formed in the hinge 3. Due to the protrusions 11 and the holes 12 of the hinge 3, the opened position of the front cover 1 relative to the bottom frame 2' can be adjusted when using the album as a picture frame or a mirror.

Figure 4A:
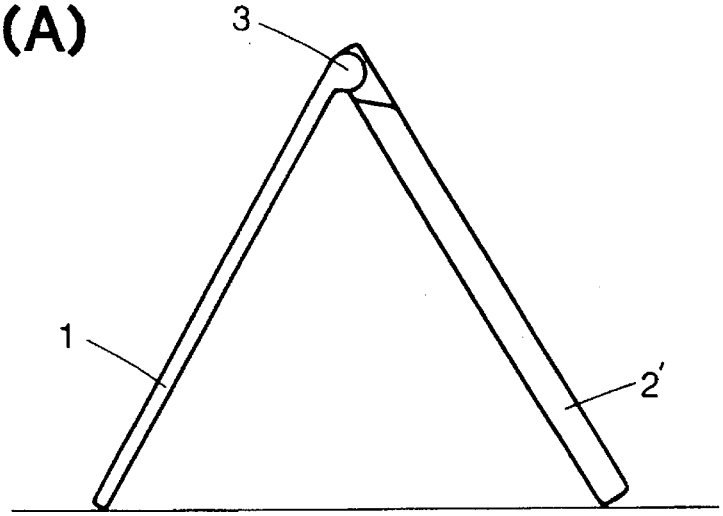
FIGS. 4A to 4C are side views of the album of this invention, showing the positions of the album used as a picture frame and a desk mirror.
Figure 4B:
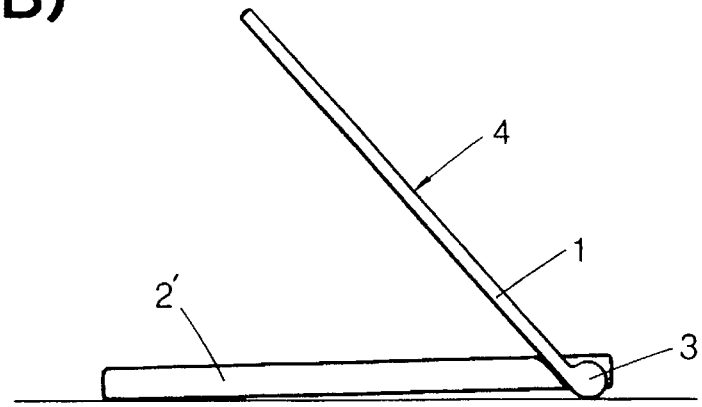
Figure 4C:
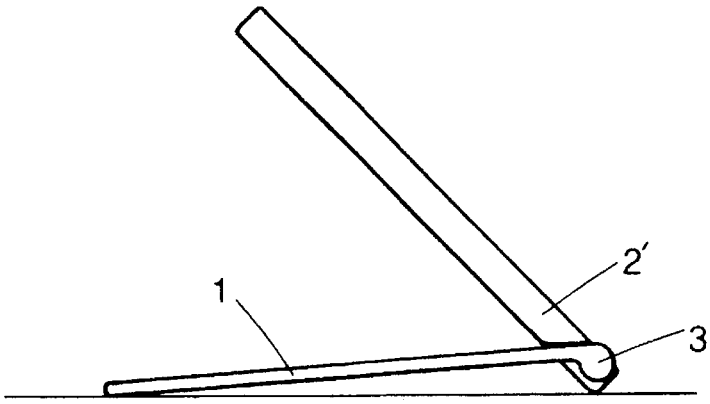

FIGS. 4A to 4C are side views showing the positions of the album of FIG. 1 when using the album for various purposes. When using the album as a picture album, the front cover 1 is opened prior to opening the binder's board sheet 7 along with the picture mount sheets 10 to the right. After the binder's board sheet 7 along with the mount sheets 10 is opened to the right, the picture mount sheets 10 are orderly turned to show the pictures 9 kept in the sheets 10. When closing the album to carry or keep the album, the picture mount sheets 10 are closed prior to closing the binder's board sheet 7. Thereafter, the front cover 1 is closed.

When using the album as a picture frame, the cover 1 is opened about the hinge 3 such that the protrusions 11 are snapped into the holes 12 of the hinge 3 as shown in FIG. 4A. In this state, a picture 9 kept in a sheet 10 show through the opening 5 of the top frame 2.

When using the album as a mirror, the cover 1 may be turned about the hinge 3 at an angle of about 180° such that the mirror 4 mounted to the inside surface of the cover 1 can be used. Alternatively, the cover 1 may be turned about the hinge 3 at an angle of about 320°. The album in this state is laid on a desk such that the bottom frame 2' is directly laid on the desk as shown in FIG. 4B. The album laid on the desk as described above may be used as a desk mirror. If the album of FIG. 4B is laid on the desk such that the cover 1 is directly laid on the desk as shown in FIG. 4C, the picture 9 in the sheet 10 show through the opening 5' of the bottom frame 2' so that the album in this state can be used as a picture frame.

Figure 5:
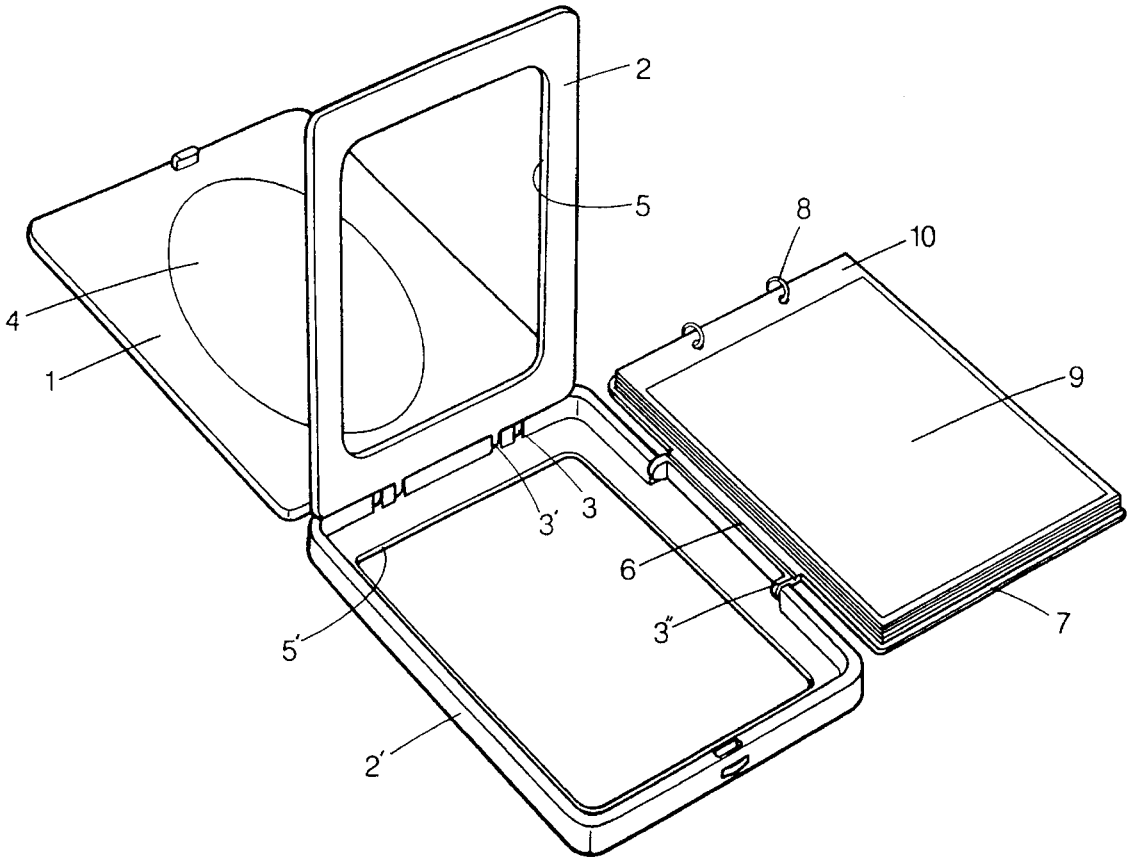
FIG. 5 is a view corresponding to FIG. 2, but showing another embodiment of the invention.

Turning to FIG. 5, there is shown an album in accordance with another embodiment of the invention. In this embodiment, the hinge 3, which pivots the front cover 1 to the bottom frame 2', is shifted inward such that the cover 1 can be only turned about the hinge 3 at 180° angle at the maximum. The structure of the album of this embodiment is further simplified by shifting the hinge 3 inward so that this album has a good appearance when using this album as a picture frame.

As described above, the present invention provides an album which keeps a plurality of pictures in a plurality of picture mount sheets which are orderly arranged in the space defined between the top and bottom frames. When the front cover is appropriately opened relative to the top and bottom frames 2 and 2', the album may be used as a picture frame or a mirror.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. For example, the hinges 3 and 3', which pivot the front cover 1 and the top frame 2 to the bottom frame 2' respectively, may be further projected up. Alternatively, the front cover 1 and the top and bottom frames 2 and 2' may be bound together using circular rings. In addition, the openings 5 and 5' of the top and bottom frames 2 and 2' may be formed into oval openings or heart-shaped openings besides the generally rectangular openings shown in the accompanying drawings.

What is claimed is:

1. An album comprising:

top and bottom frames having their openings, said top frame being pivoted to a top side of said bottom frame by means of a first hinge;

a front cover pivoted to a top side of said bottom frame by means of a second hinge such that the top frame is positioned between the front cover and the bottom frame, said cover being provided with a mirror on its inside surface and said second hinge having a protrusion and a protrusion receiving hole;

a binder's board sheet pivoted to a right side of said bottom frame by means of a third hinge such that the board sheet is positioned between the top and bottom frames, a top portion of said binder's board sheet being provided with at least one binder ring; and a plurality of picture mount sheets for keeping pictures therein, said picture mount sheets being bound on the binder's board sheet by said binder ring.

2. The album according to claim 1, wherein said binder's board sheet has a holding groove formed about said third hinge.

* * * * *